US010739690B1

(12) United States Patent
Takeuchi et al.

(10) Patent No.: US 10,739,690 B1
(45) **Date of Patent: *Aug. 11, 2020**

(54) TONER FOR ELECTROSTATIC IMAGE DEVELOPMENT ELECTROSTATIC IMAGE DEVELOPER, AND TONER CARTRIDGE

(71) Applicant: FUJI XEROX CO., LTD., Tokyo (JP)

(72) Inventors: Sakiko Takeuchi, Kanagawa (JP); Yutaka Saito, Kanagawa (JP); Yuka Yamagishi, Kanagawa (JP); Kazuhiko Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/518,461

(22) Filed: Jul. 22, 2019

(30) Foreign Application Priority Data

Mar. 22, 2019 (JP) ..... 2019-054847

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 9/09*** | (2006.01) |
| ***G03G 15/08*** | (2006.01) |
| ***G03G 9/093*** | (2006.01) |

(52) U.S. Cl.
CPC ..... *G03G 9/09725* (2013.01); *G03G 9/0819* (2013.01); *G03G 9/08711* (2013.01); *G03G 9/08755* (2013.01); *G03G 9/093* (2013.01); *G03G 9/0906* (2013.01); *G03G 9/0975* (2013.01); *G03G 9/09708* (2013.01); *G03G 9/09741* (2013.01); *G03G 15/0865* (2013.01)

(58) Field of Classification Search
CPC ..... G03G 9/09725; G03G 9/09708; G03G 9/0819
USPC ..... 430/108.2, 108.6, 111.4
See application file for complete search history.

(56) References Cited

U.S. PATENT DOCUMENTS 9,804,518 B2 * 10/2017 Matsumoto ..... G03G 9/091

FOREIGN PATENT DOCUMENTS

JP 2011-257446 A 12/2011

OTHER PUBLICATIONS

Japanese Industrial Standard Testing Methods for Transition Temperatures of plastics: JIS K 7121-1987, Jul. 20, 2012, 26 pages.

* cited by examiner

*Primary Examiner* — Mark A Chapman
(74) *Attorney, Agent, or Firm* — Sughrue Mion, PLLC

(57) ABSTRACT

A toner for electrostatic image development includes: toner base particles containing at least a nonionic surfactant, a binder resin, and a release agent; and an external additive. The content of the nonionic surfactant is from 0.05% by mass to 1% by mass inclusive based on the total mass of the toner, and the external additive contains particles with an arithmetic mean particle diameter of from 50 nm to 400 nm inclusive. The amount of the external additive released is 5% by mass or less.

13 Claims, 2 Drawing Sheets

TONER FOR ELECTROSTATIC IMAGE DEVELOPMENT ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2019-054847 filed Mar. 22, 2019.

BACKGROUND

(i) Technical Field

The present disclosure relates to a toner for electrostatic image development, to an electrostatic image developer, and to a toner cartridge.

(ii) Related Art

Visualization methods such as an electrophotographic method which visualize image information through electrostatic images are currently used in various fields.

In a conventional electrophotographic method commonly used, image information is visualized through the steps of: forming electrostatic latent images on photoconductors or electrostatic recording mediums using various means; causing electroscopic particles referred to as toner to adhere to the electrostatic latent images to develop the electrostatic latent images (toner images); transferring the developed images onto the surface of a transfer body; and fixing the images by, for example, heating.

One known conventional toner is disclosed in Japanese Unexamined Patent Application Publication No. 2011-257446.

Japanese Unexamined Patent Application Publication No. 2011-257446 discloses a toner containing: toner particles containing a binder resin, a coloring agent, a nonionic surfactant, and a charge control resin; and a fine inorganic powder, wherein the nonionic surfactant has a polyoxyalkylene chain having at least an oxyethylene group or an oxypropylene group, wherein the hydrophile-lipophile balance (HLB) value of the nonionic surfactant is from 3.5 to 16.5 inclusive, and wherein the amount of the nonionic surfactant present on the surface of the toner particles is from 500 ppm to 9,000 ppm inclusive.

SUMMARY

Aspects of non-limiting embodiments of the present disclosure relate to a toner for electrostatic image development which, while contamination of an image holding member is reduced, can form images with less toner scattering, less density unevenness, and less background fogging than images obtained using a toner in which the content of the nonionic surfactant is less than 0.05% by mass or more than 1% by mass based on the total mass of the toner, than images obtained using a toner containing, as the external additive, only inorganic particles with an arithmetic mean particle diameter of less than 50 nm or more than 400 nm, or than images obtained using a toner in which the amount of the external additive released is more than 5% by mass.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner containing: toner base particles containing at least a nonionic surfactant, a binder resin, and a release agent; and an external additive, wherein a content of the nonionic surfactant is from 0.05% by mass to 1% by mass inclusive based on a total mass of the toner, wherein the external additive contains particles with an arithmetic mean particle diameter of from 50 nm to 400 nm inclusive, and wherein an amount of the external additive released is 5% by mass or less.

BRIEF DESCRIPTION OF THE DRAWINGS

Exemplary embodiments of the present disclosure will be described in detail based on the following figures, wherein.

DETAILED DESCRIPTION

Figure 1:
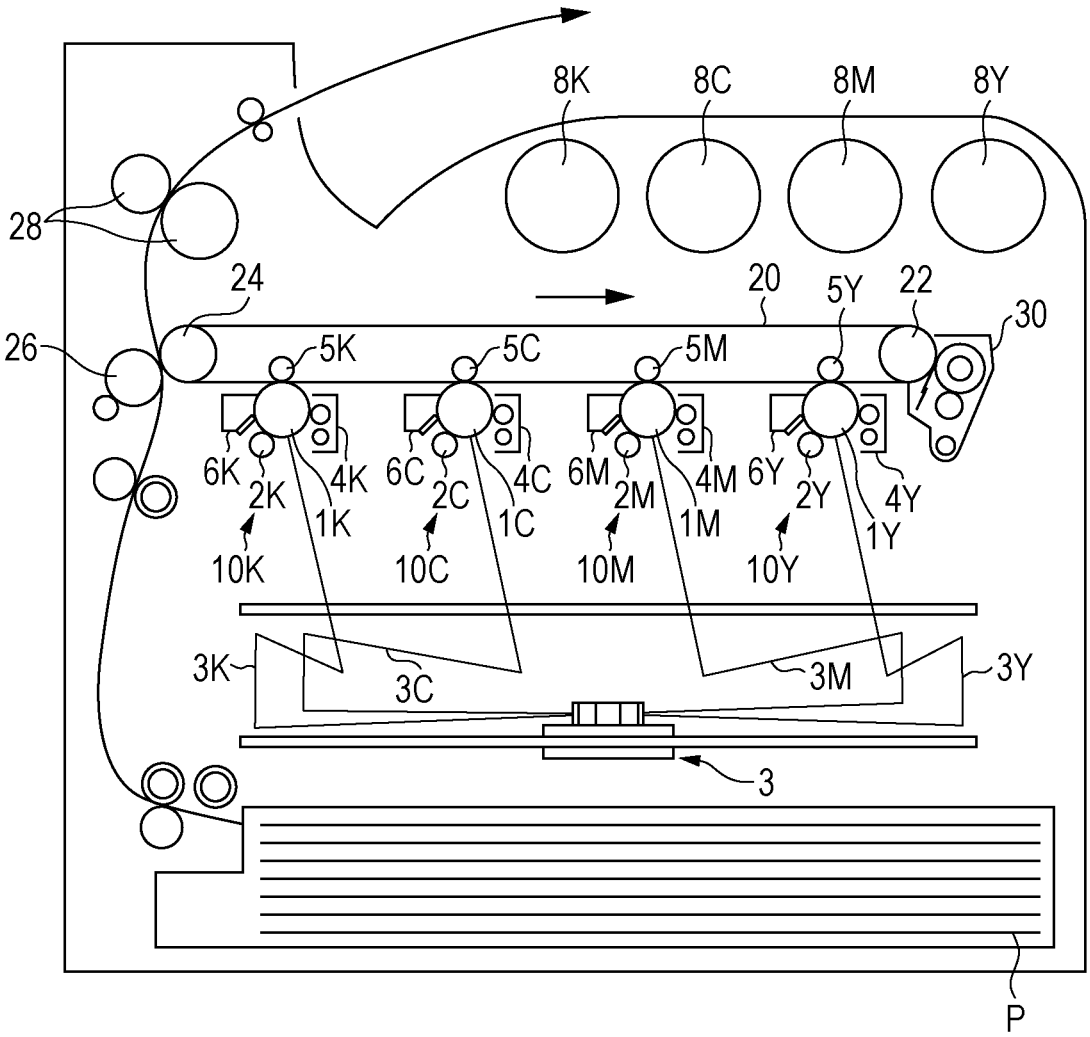
FIG. 1 is a schematic configuration diagram showing an image forming apparatus according to an exemplary embodiment.

In exemplary embodiments of the disclosure, when reference is made to the amount of a component in a composition, if the composition contains a plurality of materials corresponding to the above component, the above amount means the total amount of the plurality of materials, unless otherwise specified.

In the exemplary embodiments of the disclosure, the "toner for electrostatic image development" may be referred to simply as a "toner," and the "electrostatic image developer" may be referred to simply as a "developer."

The exemplary embodiments of the present disclosure will be described.

<Toner for Electrostatic Image Development>

A toner for electrostatic image development according to an exemplary embodiment contains: toner base particles containing at least a nonionic surfactant, a binder resin, and a release agent; and an external additive, wherein the content of the nonionic surfactant is from 0.05% by mass to 1% by mass inclusive based on the total mass of the toner, wherein the external additive contains particles with an arithmetic mean particle diameter of from 50 nm to 400 nm inclusive, and wherein the amount of the external additive released is 5% by mass or less.

In a conventional toner, unevenness in the composition of the toner on its surface is large. Therefore, the fixed state of the external additive on the surface of the toner is nonuniform, and part of the external additive is released from the toner or embedded in the toner, so that the toner particles do not interlock sufficiently with one another. In this case, disadvantageously, scattering of the toner is not sufficiently prevented.

The toner for electrostatic image development according to the present exemplary embodiment is configured as described above and can form images with less toner scattering. Although the reason for this is unclear, the reason may be as follows.

The external additive contains the particles having an arithmetic mean particle diameter of from 50 nm to 400 nm inclusive, and the content of the toner base particles is from 0.05% by mass to 1% by mass inclusive based on the total mass of the toner. Moreover, the amount of the external additive released is 5% by mass or less. In this case, the nonionic surfactant adsorbs around the materials forming the toner during production of the toner, and this allows the dispersibility of the materials to be maintained. Therefore, in the toner obtained, unevenness in the composition of the toner on its surface is small, and nonuniformity in the fixed state of the external additive on the surface of the toner is reduced. Moreover, the toner particles interlock sufficiently with one another during transfer, particularly multi-transfer, and a layer structure formed by the toner is maintained even under pressure. Therefore, in images obtained, scattering of the toner is reduced, and density unevenness and background fogging are reduced. Moreover, contamination of an image holding member is reduced.

The toner for electrostatic image development according to the present exemplary embodiment will be described in detail.

The toner according to the present exemplary embodiment is configured to include toner base particles (which may be referred to also as "toner particles") and an optional external additive.

(External Additive)

The toner for electrostatic image development according to the present exemplary embodiment contains the external additive, and the external additive contains particles (which are hereinafter referred to also as a "specific external additive") with an arithmetic mean particle diameter of from 50 nm to 400 nm inclusive. The amount of the external additive released is 5% by mass or less.

The arithmetic mean particle diameter of the specific external additive is from 50 nm to 400 nm inclusive. From the viewpoint of reducing the toner scattering in images to be obtained, reducing background fogging, and reducing contamination of the image holding member, the arithmetic mean particle diameter of the specific external additive is preferably from 60 nm to 380 nm inclusive, more preferably from 80 nm to 350 nm inclusive, and particularly preferably from 200 nm to 300 nm inclusive.

To measure the arithmetic mean particle diameter of the specific external additive in the present exemplary embodiment, the specific external additive is observed under a scanning electron microscope (S-4100 manufactured by Hitachi, Ltd.) to take an image. The image taken is introduced into image processing analysis software WinRoof (manufactured by MITANI CORPORATION). The areas of particles are determined by image analysis, and circle-equivalent diameters (nm) are determined from the areas determined. The arithmetic mean of the circle-equivalent diameters of at least 100 particles is computed and used as the arithmetic mean particle diameter.

The amount of the external additive released is 5% by mass or less. From the viewpoint of reducing toner scattering in images to be obtained and reducing contamination of the image holding member, the amount of the external additive released is preferably from 0.1% by mass to 5% by mass or less inclusive, more preferably from 0.5% by mass to 4.5% by mass inclusive, and particularly preferably from 1% by mass to 4% by mass inclusive.

Most of the specific external additive is considered to be embedded below the surface of the toner base particles and is not released, and the amount of the specific external additive released from the toner is small.

The amount of the external additive released is measured and computed by the following method.

The "amount of the external additive released" means the ratio (% by mass) of external additive particles released from the toner particles when ultrasonic vibrations with an amplitude of 65 μm are applied to an aqueous dispersion of the toner for 1 minute while the dispersion is maintained at a temperature of 40° C. to the total amount of external additive particles contained in the toner.

A method for measuring the amount of the external additive released is as follows.

2 g of the toner is dispersed in 40 mL of a 0.2 mass % aqueous surfactant solution. The dispersion is subjected to ultrasonic vibrations for 1 minute (US-300AT manufactured by NIHONSEIKI KAISHA LTD., amplitude: 65 μm) and then filtrated to thereby obtain toner base particles with the external additive removed therefrom. Next, the mixture with the ultrasonic energy imparted is subjected to suction filtration using a paper filter (product name: Qualitative Filter Paper (No. 2, 110 mm) manufactured by Advantec Toyo Kaisha, Ltd.) and washed twice with ion exchanged water. Then the particles released are removed by filtration, and the toner is dried. The amount of particles remaining in the toner subjected to the above-described particle removal treatment (this amount is referred to also as the amount of particles after dispersion) and the amount of particles in the toner not subjected to the particle removal treatment (this amount is referred to also as the amount of particles before dispersion) are quantified by a fluorescent X-ray method, and the value of the amount of particles after dispersion and the value of the amount of particles before dispersion are substituted into a formula below.

The value computed by the following formula is used as the amount of the external additive released.

Amount of external additive released (% by mass)= [(amount of particles before dispersion−amount of particles after dispersion)/amount of particles before dispersion]×100

The specific external additive may be inorganic particles or organic resin particles.

Examples of the inorganic particles include particles of $SiO_2$, $TiO_2$, metatitanic acid, titania-silica complex oxide, metatitanic acid-silica complex compounds, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Examples of the organic resin particles include particles of resins such as polystyrene, polymethyl methacrylate (PMMA), melamine resins, fluorocarbon resins, and silicone resins.

The specific external additive may be metallic soap particles.

The metallic soap used may be a well-known soap, i.e., a salt of a long-chain aliphatic acid and a metal other than sodium and potassium.

Examples of the metallic soap include: stearates of metals such as zinc, cadmium, barium, lead, iron, nickel, cobalt, copper, aluminum, magnesium, and calcium; dibasic lead stearate; oleates of metals such as zinc, magnesium, iron, cobalt, copper, lead, and calcium; palmitates of metals such as aluminum and calcium; lead caprylate; lead caproate; zinc linoleate; cobalt linoleate; calcium ricinoleate; zinc ricinoleate; cadmium ricinoleate; and mixtures thereof.

The metallic soap particles may be preferably zinc stearate particles.

In particular, from the viewpoint of reducing toner scattering in images to be obtained, the specific external additive is preferably silica particles, metatitanic acid-silica complex oxide particles, zinc stearate particles, or PMMA particles and more preferably silica particles.

The surface of the specific external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the specific external additive added externally is, for example, preferably from 0.01% by mass to 10% by mass inclusive and more preferably from 0.01% by mass to 6% by mass inclusive based on the mass of the toner base particles.

The toner for electrostatic image development according to the present exemplary embodiment may contain an additional external additive other than the specific external additive described above.

Examples of the additional external additive include inorganic particles other than the specific external additive. Examples of the material of the additional external additive include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles used as the additional external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the hydrophobic treatment agent may be, for example, from 1 part by mass to 10 parts by mass inclusive based on 100 parts by mass of the inorganic particles.

Other examples of the additional external additive include resin particles (particles of resins such as polystyrene, polymethyl methacrylate (PMMA), and melamine resins) and cleaning activators (such as metal salts of higher fatty acids typified by zinc stearate and fluorine-based polymer particles).

The amount of the additional external additive added externally is, for example, preferably from 0.01% by mass to 10% by mass inclusive and more preferably from 0.01% by mass to 6% by mass inclusive based on the mass of the toner base particles.

From the viewpoint of reducing toner scattering in images to be obtained, it is preferable that the amount of the additional external additive added externally is less than the amount of the specific external additive added externally.

(Toner Base Particles)

The toner base particles contain, for example, a nonionic surfactant, a binder resin, and a release agent and optionally contains a coloring agent and additional additives. Preferably, the toner base particles contain a nonionic surfactant, a binder resin, a coloring agent, and a release agent.

—Nonionic Surfactant—

The toner base particles contain a nonionic surfactant, and the content of the nonionic surfactant is from 0.05% by mass to 1% by mass inclusive based on the total mass of the toner.

No particular limitation is imposed on the nonionic surfactant, and any known nonionic surfactant may be used. Specific examples of the nonionic surfactant include polyoxyethylene alkyl ethers, polyoxyethylene aryl ethers, glycerin fatty acid partial esters, sorbitan fatty acid partial esters, pentaerythritol fatty acid partial esters, propylene glycol mono-fatty acid esters, sucrose fatty acid partial esters, polyoxyethylene sorbitan fatty acid partial esters, polyoxyethylene sorbitol fatty acid partial esters, polyethylene glycol fatty acid esters, polyglycerin fatty acid partial esters, polyoxyethylene glycerin fatty acid partial esters, fatty acid diethanol amides, N,N-bis-2-hydroxyalkylamines, polyoxyethylene alkylamines, triethanolamine fatty acid esters, and trialkyl amine oxides.

Other examples of the nonionic surfactant include silicone-based surfactants and fluorine-based surfactants.

In particular, from the viewpoint of reducing toner scattering in images to be obtained, the nonionic surfactant is preferably a compound having a polyalkyleneoxy structure, more preferably a compound having a polyethyleneoxy structure, still more preferably a polyoxyethylene alkyl ether compound or a polyoxyethylene aryl ether compound, and particularly preferably a polyoxyethylene lauryl ether compound or a polyoxyethylene distyrenated phenyl ether compound.

From the viewpoint of reducing toner scattering in images to be obtained, the nonionic surfactant is preferably a polyoxyethylene (the average number of moles added: from 10 moles to 60 moles inclusive) alkyl (the number of carbon atoms: from 8 to 18 inclusive) ether compound and more preferably a polyoxyethylene alkyl ether compound in which the alkyl group has 12 to 18 carbon atoms and the average number of moles added is from 12 to 18 inclusive. Specific particularly preferred examples of the nonionic surfactant include polyoxyethylene oleyl ether, polyoxyethylene stearyl ether, and polyoxyethylene lauryl ether.

A commercial nonionic surfactant may be used.

Examples of the commercial product include EMULGEN 150, EMULGEN A-60, and EMULGEN A-90 (manufactured by Kao Corporation).

The toner base particles may contain only one type of nonionic surfactant or may contain two or more types of nonionic surfactants.

The content of the nonionic surfactant is from 0.05% by mass to 1% by mass inclusive based on the total mass of the toner. From the viewpoint of reducing toner scattering in images to be obtained, reducing density unevenness in the images to be obtained, reducing background fogging, and reducing contamination of the image holding member, the content is preferably from 0.08% by mass to 0.95% by mass inclusive, more preferably from 0.1% by mass to 0.9% by mass inclusive, still more preferably from 0.2% by mass to 0.8% by mass inclusive, and particularly preferably from 0.3% by mass to 0.7% by mass inclusive.

Preferably, 50% by mass or more of the nonionic surfactant contained in the toner for electrostatic image development according to the present exemplary embodiment is a compound having a polyalkyleneoxy structure. More preferably, 80% by mass or more of the nonionic surfactant is the compound having a polyalkyleneoxy structure. Still more preferably, 90% by mass or more of the nonionic surfactant is the compound having a polyalkyleneoxy structure. Particularly preferably, 100% by mass of the nonionic surfactant is the compound having a polyalkyleneoxy structure.

From the viewpoint of reducing toner scattering in images to be obtained, reducing density unevenness in the images to be obtained, and reducing background fogging, the mass ratio ($M^B/M^A$) of the content $M^A$ of the specific external additive in the toner for electrostatic image development to the content $M^B$ of the nonionic surfactant in the toner is preferably from 0.0005 to 0.7 inclusive, more preferably from 0.001 to 0.5 inclusive, still more preferably from 0.008 to 0.5 inclusive, and particularly preferably from 0.1 to 0.3 inclusive.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

Any of these binder resins may be used alone or in combination of two or more.

The binder resin may be an amorphous (non-crystalline) resin or a crystalline resin.

From the viewpoint of reducing toner scattering in images to be obtained, it is preferable that the binder resin contains a crystalline resin, and it is more preferable that the binder resin contains an amorphous resin and a crystalline resin.

The content of the crystalline resin is preferably from 2% by mass to 40% by mass inclusive and more preferably from 2% by mass to 20% by mass inclusive based on the total mass of the binder resin.

The "crystalline" resin means that, in differential scanning calorimetry (DSC), a clear endothermic peak is observed instead of a stepwise change in the amount of heat absorbed. Specifically, the half width of the endothermic peak when the measurement is performed at a heating rate of 10 (° C./min) is 10° C. or less.

The "amorphous" resin means that the half width exceeds 10° C., that a stepwise change in the amount of heat absorbed is observed, or that a clear endothermic peak is not observed.

The polyester resin may be, for example, a well-known polyester resin.

The binder resin used may be a combination of an amorphous polyester resin and a crystalline polyester resin. The content of the crystalline polyester resin is preferably from 2% by mass to 40% by mass inclusive and more preferably from 2% by mass to 20% by mass inclusive based on the total mass of the binder resin.

—Amorphous Polyester Resin

The amorphous polyester resin may be, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof. In particular, the polycarboxylic acid is, for example, preferably an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination or two or more.

The glass transition temperature (Tg) of the amorphous polyester resin is preferably from 50° C. to 80° C. inclusive and more preferably from 50° C. to 65° C. inclusive.

The glass transition temperature is determined from a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the amorphous polyester resin is preferably from 5,000 to 1,000,000 inclusive and more preferably from 7,000 to 500,000 inclusive.

The number average molecular weight (Mn) of the amorphous polyester resin may be from 2,000 to 100,000 inclusive.

The molecular weight distribution Mw/Mn of the amorphous polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The amorphous polyester resin can be obtained by a well-known production method. For example, in one production method, the polymerization temperature is set to from 180° C. to 230° C. inclusive. If necessary, the pressure of the reaction system is reduced, and the reaction is allowed to proceed while water and alcohol generated during condensation are removed.

When raw material monomers are not dissolved or not compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present, the monomer with poor compatibility and an acid or an alcohol to be polycondensed with the monomer are condensed in advance and then the resulting polycondensation product and the rest of the components are subjected to polycondensation.

—Crystalline Polyester Resin

The crystalline polyester resin is, for example, a polycondensation product of a polycarboxylic acid and a polyhydric alcohol. The crystalline polyester resin used may be a commercial product or a synthesized product.

The crystalline polyester resin is preferably a polycondensation product using a polymerizable monomer having a linear aliphatic group rather than using a polymerizable monomer having an aromatic group, in order to facilitate the formation of a crystalline structure.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl (e.g., having 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (e.g., having 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol may be, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

The melting temperature of the crystalline polyester resin is preferably from 50° C. to 100° C. inclusive, more preferably from 55° C. to 90° C. inclusive, and still more preferably from 60° C. to 85° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The weight average molecular weight (Mw) of the crystalline polyester resin may be from 6,000 to 35,000 inclusive.

Like the amorphous polyester, the crystalline polyester resin is obtained by a well-known production method.

From the viewpoint of the scratch resistance of images, the weight average molecular weight (Mw) of the binder resin is preferably from 5,000 to 1,000,000 inclusive, more preferably from 7,000 to 500,000 inclusive, and particularly preferably from 25,000 to 60,000 inclusive. The number average molecular weight (Mn) of the binder resin is preferably from 2,000 to 100,000 inclusive. The molecular weight distribution Mw/Mn of the binder resin is preferably from 1.5 to 100 inclusive and more preferably from 2 to 60 inclusive.

The weight average molecular weight and number average molecular weight of the binder resin are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The content of the binder resin is preferably from 40% by mass to 95% by mass inclusive, more preferably from 50% by mass to 90% by mass inclusive, and still more preferably from 60% by mass to 85% by mass inclusive based on the total mass of the toner base particles.

When the toner base particles are white toner base particles, the content of the binder resin is preferably from 30% by mass to 85% by mass inclusive and more preferably from 40% by mass to 60% by mass inclusive based on the total mass of the white toner base particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The content of the release agent is preferably from 1% by mass to 20% by mass inclusive and more preferably from 5% by mass to 15% by mass inclusive based on the total mass of the toner base particles.

5'-Chloro-3-hydroxy-2'-methoxy-2-naphthanilide

From the viewpoint of reducing toner scattering in images to be obtained, the toner base particles may contain 5'-chloro-3-hydroxy-2'-methoxy-2-naphthanilide.

From the viewpoint of reducing toner scattering in images to be obtained, the mass content of 5'-chloro-3-hydroxy-2'-methoxy-2-naphthanilide in the toner for electrostatic image development according to the present exemplary embodiment is preferably from 0.1 ppm to 1,000 ppm inclusive, more preferably from 1 ppm to 3000 ppm inclusive, still more preferably from 3 ppm to 250 ppm inclusive, and particularly preferably from 10 ppm to 200 ppm inclusive.

In the present exemplary embodiment, the content of 5'-chloro-3-hydroxy-2'-methoxy-2-naphthanilide is a value quantified by the following method.

A calibration curve prepared by measuring amounts of 5'-chloro-3-hydroxy-2'-methoxy-2-naphthanilide by liquid chromatography (LC-UV) is used to determine the content of 5'-chloro-3-hydroxy-2'-methoxy-2-naphthanilide in the toner. Specifically, 0.05 g of the toner is weighed, and tetrahydrofuran is added thereto. Then the mixture is subjected to ultrasonic extraction for 30 minutes. Then the extract is collected, and acetonitrile is added to adjust the volume of the mixture to 20 mL precisely. The solution prepared is used as a sample solution and subjected to measurement by liquid chromatography (LC-UV).

—Coloring Agent—

Examples of the coloring agent include: various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

Any of these coloring agents may be used alone or in combination of two or more.

The coloring agent used may be optionally subjected to surface treatment or may be used in combination with a dispersant. A plurality of coloring agents may be used in combination.

The content of the coloring agent is, for example, preferably from 1% by mass to 30% by mass inclusive and more preferably from 3% by mass to 15% by mass inclusive based on the total mass of the toner base particles.

—Additional Additives—

Examples of additional additives include well-known additives such as a magnetic material, a charge control agent, and an inorganic powder. These additives are contained in the toner base particles as internal additives.

—Characteristics Etc. Of Toner Base Particles—

The toner base particles may have a single layer structure or may be core-shell particles each having a so-called core-shell structure including a core (core particle) and a coating layer (shell layer) covering the core. The toner base particles having the core-shell structure may each include, for example: a core containing the binder resin and optional additives such as the coloring agent and the release agent; and a coating layer containing the binder resin.

From the viewpoint of reducing toner scattering in images to be obtained, it is preferable that the toner base particles are core-shell particles.

When the toner base particles are core-shell particles, the nonionic surfactant may be contained in both the core and the shell, from the viewpoint of reducing toner scattering in images to be obtained.

The volume average particle diameter ($D_{50v}$) of the toner is preferably from 2 μm to 10 μm inclusive and more preferably from 4 μm to 8 μm inclusive.

The volume average particle diameter of the toner is measured using Coulter Multisizer II (manufactured by Beckman Coulter, Inc.), and ISOTON-II (manufactured by Beckman Coulter, Inc.) is used as an electrolyte.

In the measurement, 0.5 mg to 50 mg of a measurement sample is added to 2 mL of a 5% by mass aqueous solution of a surfactant (preferably sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the diameters of particles within the range of 2 μm to 60 μm are measured using the Coulter Multisizer II with an aperture having an aperture diameter of 100 μm. The number of particles sampled is 50,000.

The particle diameters measured are used to obtain a volumetric cumulative distribution computed from the small diameter side, and the particle diameter at a cumulative frequency of 50% is defined as the volume average particle diameter $D_{50v}$.

In the present exemplary embodiment, no particular limitation is imposed on the average circularity of the toner base particles. However, from the viewpoint of improving the ease of cleaning the toner from an image-holding member, the average circularity is preferably from 0.91 to 0.98 inclusive, more preferably from 0.94 to 0.98 inclusive, and still more preferably from 0.95 to 0.97 inclusive.

In the present exemplary embodiment, the circularity of a toner base particle is (the peripheral length of a circle having the same area as a projection image of the particle/the peripheral length of the projection image of the particle). The average circularity of the toner base particles is the circularity when a cumulative frequency computed from the small diameter side in the circularity distribution is 50%. The average circularity of the toner base particles is determined by analyzing at least 3,000 toner particles using a flow-type particle image analyzer.

When the toner base particles are produced, for example, by an aggregation/coalescence method, the average circularity of the toner base particles can be controlled by adjusting the stirring rate of a dispersion, the temperature of the dispersion, or the retention time in a fusion/coalescence step.

[Method for Producing Toner]

Next, a method for producing the toner according to the present exemplary embodiment will be described.

The toner according to the present exemplary embodiment is obtained by producing toner base particles and then externally adding the external additive to the toner base particles produced.

The toner base particles may be produced by a dry production method (such as a kneading-grinding method) or by a wet production method (such as an aggregation/coalescence method, a suspension polymerization method, or a dissolution/suspension method). No particular limitation is imposed on the production method, and any known production method may be used. In particular, the aggregation/coalescence method may be used to obtain the toner base particles.

In the kneading-grinding method, toner-forming materials including the nonionic surfactant, the binder resin, and the release agent and optionally including the coloring agent and 5'-chloro-3-hydroxy-2'-methoxy-2-naphthanilide are kneaded to obtain a kneaded mixture, and then the kneaded mixture is pulverized, whereby the toner particles are produced.

Specifically, when the toner base particles are produced, for example, by the aggregation/coalescence method, the toner base particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner base particles (a fusion/coalescence step).

5'-Chloro-3-hydroxy-2'-methoxy-2-naphthanilide may be added to the dispersion in the aggregated particle forming step.

These steps will next be described in detail.

In the following, a method for obtaining toner base particles containing the coloring agent and the release agent will be described, but the coloring agent and the release agent are used optionally. Of course, additional additives other than the coloring agent and the release agent may be used.

—Resin Particle Dispersion Preparing Step—

The resin particle dispersion in which the resin particles used as the binder resin are dispersed is prepared, and, for example, a coloring agent particle dispersion in which coloring agent particles are dispersed and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

In particular, it is preferable to use a nonionic surfactant, and it is also preferable to use a combination of a nonionic surfactant with an anionic surfactant or a cationic surfactant.

Any of these surfactants may be used alone or in combination of two or more.

To disperse the resin particles in the dispersion medium to form the resin particle dispersion, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles. In the phase inversion emulsification method, the resin to be dispersed is dissolved in a hydrophobic organic solvent that can dissolve the resin, and a base is added to an organic continuous phase (O phase) to neutralize it. Then the aqueous medium (W phase) is added to perform phase inversion from W/O to O/W, and the resin is thereby dispersed as particles in the aqueous medium.

The volume average particle diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the cumulative frequency is 50% is measured as the volume average particle diameter D50v. The volume average particle diameters of particles in other dispersions are measured in the same manner.

The content of the resin particles contained in the resin particle dispersion is preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersion.

Specifically, the descriptions of the volume average particle diameter of the particles in the resin particle dispersion, the dispersion medium for the resin particle dispersion, the dispersing method, and the content of the resin particles are applicable to the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed. In this case, the nonionic surfactant may be mixed, and 5'-chloro-3-hydroxy-2'-methoxy-2-naphthanilide may also be mixed.

Then the resin particles, the coloring agent particles, and the release agent particles are hetero-aggregated in the dispersion mixture to form aggregated particles containing the resin particles, the coloring agent particles, and the release agent particles and having diameters close to the diameters of target toner base particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles—30° C. to the glass transition temperature—10° C. inclusive) to aggregate the particles dispersed in the dispersion mixture to thereby form aggregated particles.

In the aggregated particle forming step, for example, while the dispersion mixture is agitated in a rotary shearing-type homogenizer, the flocculant is added at room temperature (e.g., 25° C.), and the pH of the dispersion mixture is adjusted to acidic (e.g., a pH of from 2 to 5 inclusive). The dispersion stabilizer may be optionally added, and the resulting mixture may be heated.

Examples of the flocculant include a surfactant with polarity opposite to the polarity of the surfactant contained in the dispersion mixture, inorganic metal salts, and divalent or higher polyvalent metal complexes. When a metal complex is used as the flocculant, the amount of the surfactant used can be reduced, and charging characteristics are improved.

An additive that forms a complex with a metal ion in the flocculant or a similar bond may be optionally used together with the flocculant. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the flocculant added is preferably from 0.01 parts by mass to 5.0 parts by mass inclusive and more preferably 0.1 parts by mass or more and less than 3.0 parts by mass based on 100 parts by mass of the resin particles.

—Fusion/Coalescence Step—

Next, the aggregated particle dispersion in which the aggregated particles are dispersed is heated, for example, to a temperature equal to or higher than the glass transition temperature of the resin particles (e.g., a temperature higher by 30° C. to 50° C. than the glass transition temperature of the resin particles) and equal to or higher than the melting temperature of the release agent to fuse and coalesce the aggregated particles to thereby form toner base particles.

In the fusion/coalescence step, the resin and the release agent are compatible with each other at the temperature equal to or higher than the glass transition temperature of the resin particles and equal to or higher than the melting temperature of the release agent. Then the dispersion is cooled to obtain a toner.

To control the aspect ratio of the release agent in the toner, the dispersion is held at a temperature around the freezing point of the release agent for a given time during cooling to grow the crystals of the release agent. Alternatively, two or more types of release agents with different melting temperatures are used. In this case, crystal growth during cooling can be facilitated, and the aspect ratio can be controlled.

The toner base particles are obtained through the above-described steps.

Alternatively, the toner base particles may be produced through: the step of, after the preparation of the aggregated particle dispersion containing the aggregated particles dispersed therein, mixing the aggregated particle dispersion further with the resin particle dispersion containing the resin particles dispersed therein and then causing the resin particles to adhere to the surface of the aggregated particles to aggregate them to thereby form second aggregated particles; and the step of heating a second aggregated particle dispersion containing the second aggregated particles dispersed therein to fuse and coalesce the second aggregated particles to thereby form toner base particles having the core-shell structure.

After completion of the fusion/coalescence step, the toner base particles formed in the solution are subjected to a well-known washing step, a solid-liquid separation step, and a drying step to obtain dried toner base particles. From the viewpoint of chargeability, the toner base particles may be subjected to displacement washing with ion exchanged water sufficiently in the washing step. From the viewpoint of productivity, suction filtration, pressure filtration, etc. may be performed in the solid-liquid separation step. From the viewpoint of productivity, freeze-drying, flash drying, fluidized drying, vibrating fluidized drying, etc. may be performed in the drying step.

The toner according to the present exemplary embodiment is produced, for example, by adding the external additive to the dried toner base particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Electrostatic Image Developer>

An electrostatic image developer according to an exemplary embodiment contains at least the toner according to the preceding exemplary embodiment. The electrostatic image developer according to the present exemplary embodiment may be a one-component developer containing only the toner according to the preceding exemplary embodiment or may be a two-component developer containing a mixture of the toner and a carrier.

No particular limitation is imposed on the carrier, and a well-known carrier may be used. Examples of the carrier include: a coated carrier prepared by coating the surface of a core material formed of a magnetic powder with a resin; a magnetic powder-dispersed carrier prepared by dispersing a magnetic powder in a matrix resin; and a resin-impregnated carrier prepared by impregnating a porous magnetic powder with a resin. In each of the magnetic powder-dispersed carrier and the resin-impregnated carrier, the particles included in the carrier may be used as cores, and their surface may be coated with a resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins. The coating resin and the matrix resin may contain an additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

To coat the surface of the core material with a resin, the surface of the core material may be coated with a coating layer-forming solution prepared by dissolving the coating resin and various additives (used optionally) in an appropriate solvent. No particular limitation is imposed on the solvent, and the solvent may be selected in consideration of the type or resin used, ease of coating, etc. Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Image Forming Apparatus and Image Forming Method>

An image forming apparatus and an image forming method in an exemplary embodiment will be described.

The image forming apparatus in the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachably attached to the image forming apparatus. The process cartridge used may be, for example, a process cartridge that includes the developing means containing the electrostatic image developer according to the preceding exemplary embodiment.

An example of the image forming apparatus in the present exemplary embodiment will be described, but this is not a limitation. In the following description, major components shown in FIG. 1 will be described, and description of other components will be omitted.

FIG. 1 is a schematic configuration diagram showing the image forming apparatus in the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (which may be hereinafter referred to simply as "units") 10Y, 10M, 10C, and 10K are arranged so as to be spaced apart from each other horizontally by a prescribed distance. These units 10Y, 10M, 10C, and 10K may each be a process cartridge detachable from the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 that are in contact with the inner surface of the intermediate transfer belt 20 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer belt cleaner 30 is disposed on an image holding surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of image-holding member cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown). The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P with the toner image transferred thereon is transported to a press contact portion (nip portion) of a pair of fixing rollers in a fixing device (an example of the fixing means) 28, and the toner image is fixed onto the recording paper sheet P to thereby form a fixed image. The recording paper sheet P with the color image fixed thereon is transported to an ejection portion, and a series of the color image formation operations is thereby completed.

Examples of the recording paper sheet P onto which a toner image is to be transferred include plain paper sheets used for electrophotographic copying machines, printers, etc. Examples of the recording medium include, in addition to the recording paper sheets P, transparencies. To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

<Process Cartridge and Toner Cartridge>

A process cartridge according to an exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachable from the image forming apparatus.

The process cartridge according to the present exemplary embodiment may include the developing means and at least one optional unit selected from other means such as an image holding member, charging means, electrostatic image forming means, and transferring means.

An example of the process cartridge according to the present exemplary embodiment will be shown, but this is not a limitation. In the following description, major components shown in FIG. 2 will be described, and description of other components will be omitted.

Figure 2:
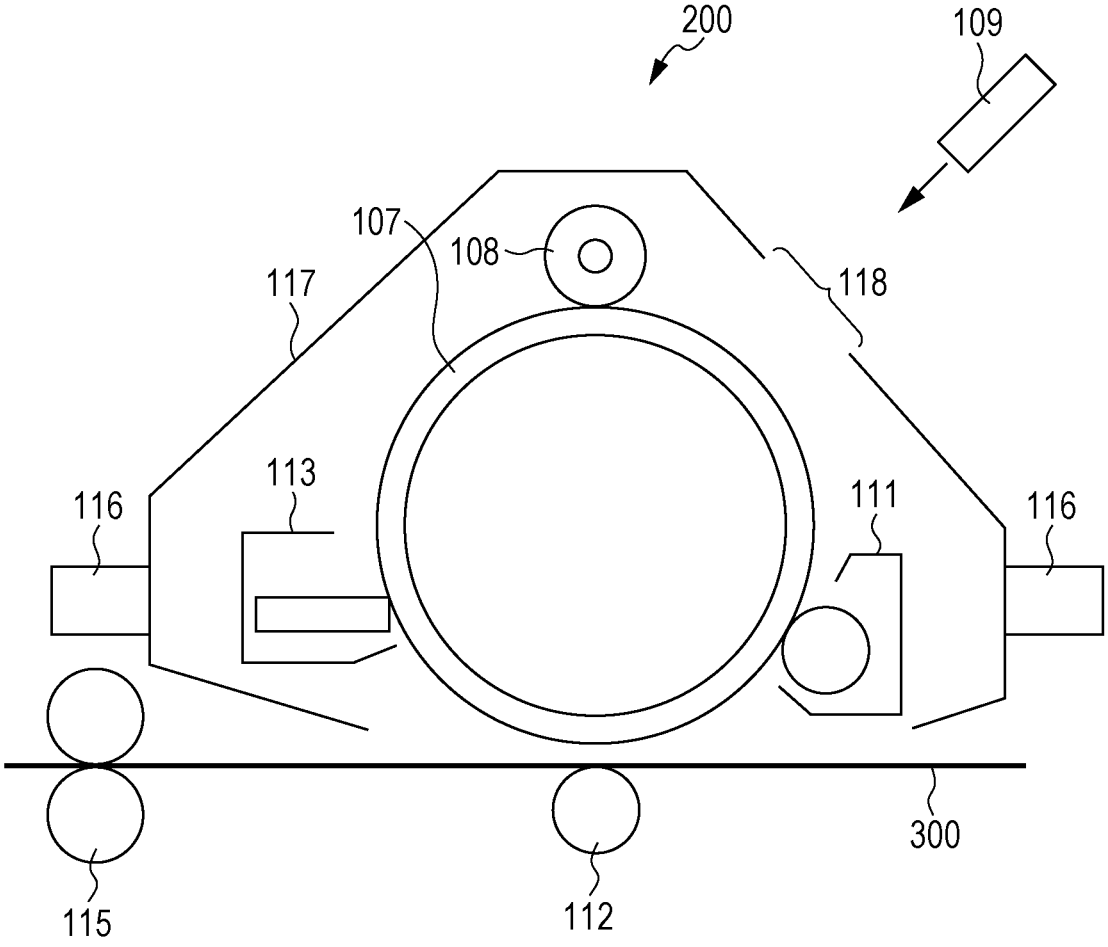
FIG. 2 is a schematic configuration diagram showing a process cartridge according to an exemplary embodiment.

FIG. 2 is a schematic configuration diagram showing an example of the process cartridge according to the present exemplary embodiment.

The process cartridge 200 shown in FIG. 2 includes, for example, a housing 117 including mounting rails 116 and an opening 118 for light exposure and further includes: a photoconductor 107 (an example of the image holding member); a charging roller 108 (an example of the charging means) disposed on the circumferential surface of the photoconductor 107; a developing device 111 (an example of the developing means); and a photoconductor cleaner 113 (an example of the cleaning means), which are integrally combined and held in the housing 117 to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

Next, a toner cartridge according to an exemplary embodiment will be described.

The toner cartridge according to the present exemplary embodiment contains the toner according to the preceding exemplary embodiment and is detachably attached to the image forming apparatus. The toner cartridge contains a replenishment toner to be supplied to the developing means disposed in the image forming apparatus.

The image forming apparatus shown in FIG. 1 has a structure in which the toner cartridges 8Y, 8M, 8C, and 8K are detachably attached. The developing devices 4Y, 4M, 4C, and 4K are connected to their respective toner cartridges through unillustrated toner supply tubes. When the amount of the toner remaining in a toner cartridge is small, this toner cartridge is replaced.

EXAMPLES

Examples of the present disclosure will next be described. However, the present disclosure is not limited to these Examples. In the following description, "parts" and "%" are based on mass, unless otherwise specified.

The arithmetic mean particle diameter of the specific external additive, the amount of the specific external additive released, and the content of 5'-chloro-3-hydroxy-2'-methoxy-2-naphthanilide are measured by the methods described above.

<Preparation of Polyester Resin Particle Dispersion>

2.2-Mole ethylene oxide adduct of bisphenol A: 40 parts by mole 2.2-Mole propylene oxide adduct of bisphenol A: 60 parts by mole Dimethyl terephthalate: 60 parts by mole Dimethyl fumarate: 15 parts by mole Dodecenyl succinic acid anhydride: 20 parts by mole Trimellitic anhydride: 5 parts by mole A reaction vessel equipped with a stirrer, a thermometer, a condenser, and a nitrogen introduction tube is charged with the above monomers except for fumaric acid and trimellitic anhydride and with 0.25 parts of tin dioctoate based on 100 parts of the total amount of the above monomers. The mixture is allowed to react at 235° C. for 6 hours in nitrogen gas flow and then cooled to 200° C. Fumaric acid and trimellitic anhydride are added, and the resulting mixture is allowed to react for 1 hour. The temperature of the mixture is increased to 220° C. over 5 hours, and the monomers are polymerized at a pressure of 10 kPa until the desired molecular weight is reached to thereby obtain a clear light yellow polyester resin. The polyester resin has a weight average molecular weight of 35,000, a number average molecular weight of 8,000, and a glass transition temperature of 59° C.

Next, the polyester resin obtained is dispersed using a high-temperature high-pressure disperser obtained by modifying CAVITRON CD1010 (manufactured by EUROTEC Co., Ltd.). A mixture with a composition of 80% ion exchanged water and 20% the polyester resin is prepared, and its pH is adjusted to 8.5 with ammonia. The CAVITRON is operated under the conditions of a rotor rotation speed of 60 Hz and a pressure of 5 kg/cm$^2$ at 140° C. under heating by a heat exchanger to thereby obtain a polyester resin dispersion (solid content: 20%).

The volume average particle diameter of the resin particles in the dispersion is 130 nm. Ion exchanged water is added to the dispersion to adjust the solid content to 20%, and the resulting dispersion is used as a polyester resin particle dispersion.

<Preparation of Coloring Agent Particle Dispersion>

Magenta pigment (C.I. Pigment Red 238 manufactured by SANYO COLOR WORKS, Ltd.): 70 parts Anionic surfactant (NEOGEN RK manufactured by DAI-ICHI KOGYO SEIYAKU Co., Ltd.): 1 part Ion exchanged water: 200 parts The above materials are mixed and dispersed for 10 minutes using a homogenizer (ULTRA-TURRAX T50 manufactured by IKA). Ion exchanged water is added such that the solid content in the dispersion is 20% by mass to thereby obtain a coloring agent particle dispersion in which coloring agent particles with a volume average particle diameter of 190 nm are dispersed.

<Preparation of Release Agent Particle Dispersion>

Polyethylene-based wax (hydrocarbon wax: product name "POLYWAX 725" manufactured by Baker Petrolite, melting temperature: 104° C.): 270 parts Anionic surfactant (NEOGEN RK manufactured by DAI-ICHI KOGYO SEIYAKU Co., Ltd., amount of effective component: 60%): 13.5 parts (the amount of the effective component with respect to the release agent: 3.0%)

Ion exchanged water: 21.6 parts

The above components are mixed, and the release agent is dissolved using a pressure discharge-type homogenizer (Gaulin homogenizer manufactured by Gaulin) at an internal solution temperature of 120° C. Then the mixture is subjected to dispersion treatment at a dispersion pressure of 5

MPa for 120 minutes and then at a dispersion pressure of 40 MPa for 360 minutes, and the resulting mixture is cooled to thereby obtain a release agent particle dispersion. The volume average particle diameter D50 of the particles in the release agent particle dispersion is 225 nm. Then ion exchanged water is added to adjust the solid concentration to 20.0%.

Examples 1 to 5 and 7 to 19 and Comparative Examples 1 to 6

<Production of Toner>

—Production of toner base particles (1)—

Polyester resin particle dispersion: 100 parts by mass
Coloring agent particle dispersion: 10 parts by mass
Release agent particle dispersion: 9 parts by mass
5'-Chloro-3-hydroxy-2'-methoxy-2-naphthanilide (manufactured by TOKYO CHEMICAL INDUSTRY Co., Ltd., diluted to a 1% aqueous solution before use): 0.2 parts by mass
Nonionic surfactant shown in Table 1: 0.1 parts by mass
Anionic surfactant (TaycaPower manufactured by Tayca Corporation): 0.1 parts by mass
0.3M (mol/L) aqueous nitric acid solution: 0.4 parts by mass
Ion exchanged water: 200 parts by mass The above components are placed in a stainless steel-made round bottom flask, dispersed using a homogenizer (ULTRA-TURRAX T50 manufactured by IKA), then heated to 42° C. in a heating oil bath, and held for 30 minutes. When the formation of aggregated particles is found, 50 parts by mass of the polyester resin particle dispersion is additionally added, and the resulting mixture is held for 30 minutes. Then sodium nitrilotriacetate (Chelest 70 manufactured by Chubu Chelest Co., Ltd.) is added such that its concentration is 3% by mass of the total mass of the solution. Then a 1N (=mol/L) aqueous sodium hydroxide solution is gradually added until the pH reaches 7.2, and the mixture is heated to 85° C. under continuous stirring and held for 3.0 hours. Then the reaction product is filtrated, washed with ion exchanged water, and dried using a vacuum dryer to thereby obtain toner base particles.

—Production of Toner—

1 Part of silica particles (hydrophobic silica: RX50 manufactured by Nippon Aerosil Co., Ltd.) having a primary particle diameter (arithmetic mean diameter) of 40 nm and subjected to surface hydrophobic treatment, 0.8 parts of metatitanic acid compound particles having a primary particle diameter (arithmetic mean diameter) of 20 nm and obtained as a reaction product prepared by treating metatitanic acid with isobutyltrimethoxysilane, a specific external additive shown in Table 2 in an amount shown in Table 2 are added to 100 parts of the toner base particles. Then these components are mixed using a Henschel mixer under conditions shown in Table 1 below such that a release amount shown in Table 2 is achieved. Then the resultant mixture is sieved using Resonasieve (manufactured by TOKUJU CORPORATION) to thereby obtain a toner for electrostatic image development.

TABLE 1

| Release amount | Peripheral speed | Time | Temperature |
|---|---|---|---|
| 1% by mass | 55 m/sec | 45 min | 45° C. |
| 3% by mass | 55 m/sec | 30 min | 45° C. |

TABLE 1-continued

| Release amount | Peripheral speed | Time | Temperature |
|---|---|---|---|
| 5% by mass | 55 m/sec | 10 min | 45° C. |
| 10% by mass | 55 m/sec | 10 min | 20° C. |

<Production of Electrostatic Image Developer>

8 Parts by mass of one of the obtained toners for electrostatic image development and 100 parts by mass of a ferrite carrier (average particle diameter: 35 μm) coated with a resin are mixed to prepare a two-component developer. In this manner, developers (electrostatic image developers) are obtained. The developers obtained are filled into developing units of DocuPrint C2220 (manufactured by Fuji Xerox Co., Ltd.) and seasoned in a low-temperature low-humidity environment (10° C./15% RH) for 24 hours.

<Evaluation of Reduction in Toner Scattering>

A "700 Digital Color Press" manufactured by Fuji Xerox Co., Ltd. is prepared, and one of the magenta developers obtained in the Examples and Comparative Examples is filled into a developing unit. A magenta solid image is formed continuously on 100 A4 paper sheets in an environment of a temperature of 25° C. and a humidity of 30% RH. Then a lattice image is formed using 10 pt straight lines. The degree of toner scattering in the lattice image formed on the 101st sheet is observed and rated on a four-point scale, A to D. The evaluation criteria are as follows.

A: No toner scattering is found in image boundary portions even under a 50× loupe.

B: Slight toner scattering is found in image boundary portions under the 50× loupe, but the toner scattering is not noticeable with naked eyes.

C: Slight toner scattering is found by naked eyes but does not cause any practical problem.

D: Scattering is easily found by naked eyes and causes a practical problem.

<Evaluation of Image Density Unevenness, Background Fogging, and Contamination of Photoconductor (Image Holding Member)>

Evaluation machine: printer with increased speed obtained by modifying DocuCentre f1100 manufactured by Fuji Xerox Co., Ltd.

Processing speed: 450 mm/second Fixing temperature: variable from 80° C. to 180° C. Evaluation paper: paper J manufactured by Fuji Xerox Co., Ltd.

—Evaluation—

The developers are evaluated after left to stand at a temperature of 30° C. and a humidity of 85% RH for one week. Each of the developers is used to print a chart including a solid image and letters continuously on 5,000 A4 sheets (paper P manufactured by Fuji Xerox Co., Ltd.) using a printer obtained by modifying DocuPrint C1616 (manufactured by Fuji Xerox Co., Ltd.). Image density unevenness and background fogging in the fixed image on the last printed sheet are evaluated, and contamination of the photoconductor (image holding member) is also evaluated.

<<Method for Evaluating Image Density Unevenness (Reduction in Image Density Unevenness)>>

The density is measured at 10 random points in the image area of the last printed sheet using X-rite 939 (manufactured by X-rite), and the difference between maximum and minimum image densities is determined and used as the image density unevenness. The smaller the difference (density unevenness), the better.

A: density unevenness≤0.01

B: 0.01<density unevenness≤0.03

C: 0.03<density unevenness≤0.05

D: 0.05<density unevenness

<<Method for Evaluating Background Fogging (Reduction in Background Fogging)>>

The density is measured at 10 random points in a non-image portion of the last printed sheet using X-rite 939 (manufactured by X-rit), and the average of the measured values is computed and used as background fogging (fogging). The smaller the fogging value, the better.

A: fogging<0.01

B: 0.01≤fogging<0.03

C: 0.03≤fogging<0.05

D: 0.05<fogging

<<Surface State of Photoconductor (Reduction in Contamination of Image Holding Member)>>

The surface state of the photoconductor after the last printed sheet is printed is observed under a 50× loupe and evaluated according to the following criteria.

A: No adhering substances and no filming are found even by observation under the loupe.

B: Thin adhering substances extending circumferentially are found under the loupe but are not present in the image.

B⁻: Flaws and adhering substances are found but do not cause serious influences on the image.

C: Small surface flaws and image density unevenness are found and cause a slight practical problem.

D: Image defects and flaws are found and cause a practical problem.

Example 6

—Preparation of Amorphous Polymer Dispersion (A)—

Styrene: 740 parts n-Butyl acrylate: 60 parts

Acrylic acid: 8 parts

Dodecanethiol: 48 parts

Carbon tetrabromide: 8 parts

The above materials are mixed, dissolved, and dispersed in a flask containing a mixture prepared by dissolving 32 parts of an anionic surfactant (NEOGEN SC manufactured by DAI-ICHI KOGYO SEIYAKU Co., Ltd.) in 1,000 parts of ion exchanged water. The dispersion is emulsified and gently mixed for 10 minutes. 100 Parts of ion exchanged water containing 8 parts of ammonium persulfate dissolved therein is added under stirring, and the resulting mixture is purged with nitrogen. While the contents of the flask are stirred, the flask is heated in an oil bath until the contents are heated to 70° C., and emulsion polymerization is continued in this state for 5 hours. An amorphous polymer dispersion (A) (resin particle concentration: 40% by mass) is thereby prepared. The amorphous polymer dispersion (A) contains dispersed therein resin particles having a volume average particle diameter of 180 nm, a glass transition point of 59° C., and a weight average molecular weight (Mw) of 15,000.

—Preparation of Coloring Agent Dispersion (A)—

500 Parts of a cyan pigment (ECB-301 manufactured by Dainichiseika Color & Chemicals Mfg. Co., Ltd.), 40 parts of an anionic surfactant (NEOGEN RK manufactured by DAI-ICHI KOGYO SEIYAKU Co., Ltd.), and 1,460 parts of ion exchanged water are mixed, dissolved, and then dispersed using a homogenizer (ULTRA-TURRAX manufactured by IKA) to thereby prepare a coloring agent dispersion (A) containing the coloring agent (cyan pigment) dispersed therein.

—Preparation of Release Agent Dispersion (A)—

700 Parts of a release agent (RIKEMAL B-200 manufactured by RIKEN VITAMIN Co., Ltd., melting point: 68° C.), 30 parts of an anionic surfactant (NEOGEN RK manufactured by DAI-ICHI KOGYO SEIYAKU Co., Ltd.), and 1,270 parts of ion exchanged water are mixed and dispersed using a homogenizer (ULTRA-TURRAX manufactured by IKA) under heating to 90° C. in a water bath to thereby prepare a release agent dispersion.

—Preparation of Toner (A) for Electrostatic Image Development—

A stainless steel-made round bottom flask is charged with 1,600 parts of the amorphous polymer dispersion (A), 55 parts of the coloring agent dispersion (A), 101 parts of the release agent dispersion, 5 parts of calcium chloride (manufactured by FUJIFILM Wako Pure Chemical Corporation), 200 pars of ion exchanged water, 0.2 parts by mass of 5'-chloro-3-hydroxy-2'-methoxy-2-naphthanilide (manufactured by TOKYO CHEMICAL INDUSTRY Co., Ltd.), and 0.1 parts by mass of a nonionic surfactant shown in Table 2, and the pH of the mixture is adjusted to 4.0. The mixture is dispersed using a homogenizer (ULTRA-TURRAX T50 manufactured by IKA) and heated to 55° C. in a heating oil bath under stirring. The mixture is held at 55° C. for 3 hours and then observed under an optical microscope, and aggregated particles with a volume average particle diameter of about 5.0 μm are found to be formed. The heating at 55° C. is continued for 1 hour under stirring, and the mixture is observed under the optical microscope. Aggregated particles with a volume average particle diameter of about 5.5 μm are found to be formed.

130 Parts of the amorphous polymer dispersion (A) is further added to the aggregated particle dispersion under continuous stirring. The pH in this case is 3.8. Therefore, an aqueous solution prepared by diluting sodium carbonate (manufactured by FUJIFILM Wako Pure Chemical Corporation) to 0.5% by mass is gently added to adjust the pH to 5.0. The resulting aggregated particle dispersion is heated to 65° C. under continuous stirring, held for 30 minutes, and further heated to 80° C., held for 60 minutes, and observed under an optical microscope, and coated spherical toner particles are found to be observed. Then the dispersion is cooled to 20° C. at a rate of 100° C./minutes while ion exchanged water is added to thereby solidify the particles.

Then the reaction product is filtrated, washed sufficiently with ion exchanged water, and dried using a vacuum dryer to thereby obtain toner base particles (A).

A toner and an electrostatic image developer are obtained in the same manner as in Example 1 except that the toner base particles (A) obtained and conditions shown in Table 2 are used.

The evaluation results are summarized in Table 2.

TABLE 2

| | Nonionic surfactant | | Specific external additive | | | | | | | | Evaluation | | | |
|---|---|---|---|---|---|---|---|---|---|---|---|---|---|---|
| | Type | Content $M^B$ (% by mass) | Type | Arithmetic mean particle diameter (nm) | Content $M^A$ (% by mass) | Release amount (% by mass) | $M^B/M^A$ | Content of 5'-chloro-3-hydroxy-2'-methoxy-2-naphthanilide (ppm) | Type of binder resin | Scattering of toner | Reduction in density unevenness | Background fogging | Reduction in contamination of photoconductor |
| Example 1 | NS1 | 0.4 | [1] | 250 | 2.0 | 3 | 0.20 | 150 | Polyester | A | A | A | A |
| Example 2 | NS2 | 0.4 | [1] | 250 | 2.0 | 3 | 0.20 | 150 | Polyester | A | A | A | A |
| Example 3 | NS3 | 0.4 | [1] | 250 | 2.0 | 3 | 0.20 | 150 | Polyester | A | A | A | A |
| Example 4 | NS1 | 0.4 | [2] | 250 | 2.0 | 3 | 0.20 | 150 | Polyester | A | A | A | A |
| Example 5 | NS1 | 0.4 | [3] | 250 | 2.0 | 3 | 0.20 | 150 | Polyester | A | A | A | A |
| Example 6 | NS1 | 0.4 | [1] | 250 | 2.0 | 3 | 0.20 | 150 | Styrene-acrylic resin | A | A | A | A |
| Example 7 | NS1 | 1 | [1] | 250 | 2.0 | 3 | 0.50 | 150 | Polyester | A | A | C | A |
| Example 8 | NS1 | 0.05 | [1] | 250 | 2.0 | 3 | 0.03 | 150 | Polyester | B | C | A | A |
| Example 9 | NS1 | 0.4 | [1] | 400 | 2.0 | 3 | 0.20 | 150 | Polyester | B | A | A | C |
| Example 10 | NS1 | 0.4 | [1] | 50 | 2.0 | 3 | 0.20 | 150 | Polyester | B | A | C | A |
| Example 11 | NS1 | 0.4 | [1] | 250 | 2.0 | 5 | 0.20 | 150 | Polyester | B | A | A | C |
| Example 12 | NS1 | 0.4 | [1] | 250 | 2.0 | 1 | 0.20 | 150 | Polyester | C | A | A | A |
| Example 13 | NS1 | 0.06 | [1] | 250 | 7.0 | 3 | 0.008 | 150 | Polyester | B | B | A | A |
| Example 14 | NS1 | 0.7 | [1] | 250 | 1.0 | 3 | 0.70 | 150 | Polyester | A | A | C | A |
| Example 15 | NS1 | 0.05 | [1] | 250 | 9.0 | 3 | 0.006 | 150 | Polyester | C | C | A | A |
| Example 16 | NS1 | 0.4 | [1] | 250 | 2.0 | 3 | 0.20 | 300 | Polyester | A | A | B | A |
| Example 17 | NS1 | 0.4 | [1] | 250 | 2.0 | 3 | 0.20 | 1 | Polyester | B | B | A | A |
| Example 18 | NS1 | 0.4 | [1] | 250 | 2.0 | 3 | 0.20 | 500 | Polyester | A | A | C | A |
| Example 19 | NS1 | 0.4 | [1] | 250 | 2.0 | 3 | 0.20 | 0.01 | Polyester | C | C | A | A |
| Comparative Example 1 | NS1 | 1.5 | [1] | 250 | 3.0 | 3 | 0.50 | 150 | Polyester | A | A | D | A |
| Comparative Example 2 | NS1 | 0.02 | [1] | 250 | 2.0 | 3 | 0.010 | 150 | Polyester | C | D | A | A |
| Comparative Example 3 | NS1 | 0 | [1] | 250 | 2.0 | 3 | 0 | 150 | Polyester | D | D | A | A |
| Comparative Example 4 | NS1 | 0.4 | [1] | 500 | 2.0 | 3 | 0.20 | 150 | Polyester | C | A | A | D |
| Comparative Example 5 | NS1 | 0.4 | [1] | 30 | 2.0 | 3 | 0.20 | 150 | Polyester | C | A | D | A |
| Comparative Example 6 | NS1 | 0.4 | [1] | 250 | 2.0 | 10 | 0.20 | 150 | Polyester | C | A | A | D |

The details of abbreviations in Table 2 other than those described above are shown below.

NS1: polyoxyethylene lauryl ether (EMULGEN 150 manufactured by Kao Corporation)

NS2: polyoxyethylene distyrenated phenyl ether (EMULGEN A-60 manufactured by Kao Corporation)

NS3: polyoxyethylene distyrenated phenyl ether (EMULGEN A-90 manufactured by Kao Corporation)

As can be seen from the results shown in Table 2, in the toners for electrostatic image development in the Examples, their ability to reduce toner scattering in images to be obtained, reduce density unevenness in the images, reduce background fogging, and reduce contamination of the image holding member is better than that of the toners for electrostatic image development in the Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for electrostatic image development comprising:

toner base particles containing at least a nonionic surfactant, a binder resin, and a release agent; and an external additive, wherein a content of the nonionic surfactant is from 0.05% by mass to 1% by mass inclusive based on a total mass of the toner, wherein the external additive contains particles with an arithmetic mean particle diameter of from 50 nm to 400 nm inclusive, and wherein an amount of the external additive released is 5% by mass or less.

2. The toner for electrostatic image development according to claim 1, wherein a mass ratio ($M^B/M^A$) of a content $M^A$ of the particles in the toner for electrostatic image development to a content $M^B$ of the nonionic surfactant in the toner is from 0.008 to 0.5 inclusive.

3. The toner for electrostatic image development according to claim 1, wherein the toner base particles further contain a coloring agent.

4. The toner for electrostatic image development according to claim 1, wherein the toner base particles further contain 5'-chloro-3-hydroxy-2'-methoxy-2-naphthanilide.

5. The toner for electrostatic image development according to claim 4, wherein a content of the 5'-chloro-3-hydroxy-2'-methoxy-2-naphthanilide is from 1 ppm to 300 ppm inclusive based on the total mass of the toner.

6. The toner for electrostatic image development according to claim 1, wherein the nonionic surfactant is a compound having a polyalkyleneoxy structure.

7. The toner for electrostatic image development according to claim 6, wherein the nonionic surfactant is a compound having a polyethyleneoxy structure.

8. The toner for electrostatic image development according to claim 1, wherein an amount of the external additive added externally is from 0.01% by mass to 10% by mass inclusive based on the mass of the toner base particles.

9. The toner for electrostatic image development according to claim 1, wherein the external additive has a surface subjected to hydrophobic treatment.

10. The toner for electrostatic image development according to claim 1, wherein the external additive is silica particles.

11. The toner for electrostatic image development according to claim 1, wherein the toner base particles are core-shell particles.

12. An electrostatic image developer comprising the toner for electrostatic image development according to claim 1.

13. A toner cartridge comprising the toner for electrostatic image development according to claim 1, the toner being housed in the toner cartridge, the toner cartridge being detachably attached to an image forming apparatus.

* * * * *